United States Patent [19]

Masters

[11] Patent Number: 4,715,311

[45] Date of Patent: Dec. 29, 1987

[54] VARIABLE VOLUME KAYAK HULL

[76] Inventor: William E. Masters, P.O. Box 686, Liberty, S.C. 29657

[21] Appl. No.: 33,850

[22] Filed: Apr. 6, 1987

Related U.S. Application Data

[63] Continuation of Ser. No. 766,567, Aug. 19, 1985, abandoned.

[51] Int. Cl.[4] ..... B63B 35/72

[52] U.S. Cl. ..... 114/347; 114/355; 114/364

[58] Field of Search ..... 114/345, 347, 349, 352, 114/354, 355, 364, 287, 56, 83, 121; 441/40

[56] References Cited

U.S. PATENT DOCUMENTS

| | | | |
|---|---|---|---|
| 2,612,129 | 9/1952 | Burch | 114/56 |
| 2,999,253 | 9/1961 | Lewis | 114/347 |
| 4,227,272 | 10/1980 | Masters | 114/347 |
| 4,480,579 | 11/1984 | Masters | 114/347 |

FOREIGN PATENT DOCUMENTS

| | | | |
|---|---|---|---|
| 2655838 | 5/1978 | Fed. Rep. of Germany | 114/347 |
| 2539097 | 7/1984 | France | 114/347 |
| 2134454 | 8/1984 | United Kingdom | 114/347 |

*Primary Examiner*—Jeffrey V. Nase
*Assistant Examiner*—Clifford T. Bartz
*Attorney, Agent, or Firm*—Cort Flint

[57] ABSTRACT

A kayak 10 having at least one hull section 16, 18 whose volume may be adjusted to enable said hull section to be submerged by a boater for water acrobatics comprises spaced longitudinal frames 22, 24 connected to the hull section. The spacing between the frames may be varied to proscribe the configuration of the hull section over a substantial part or short segment of its length. The frames 22, 24 may be interconnected by flexible cabling 30, 32 or by a mechanical scissor linkage 48 to change this spacing and adjust the volume. Supportive framework (70, 72) is provided to prevent total collapse of said hull sections.

21 Claims, 10 Drawing Figures

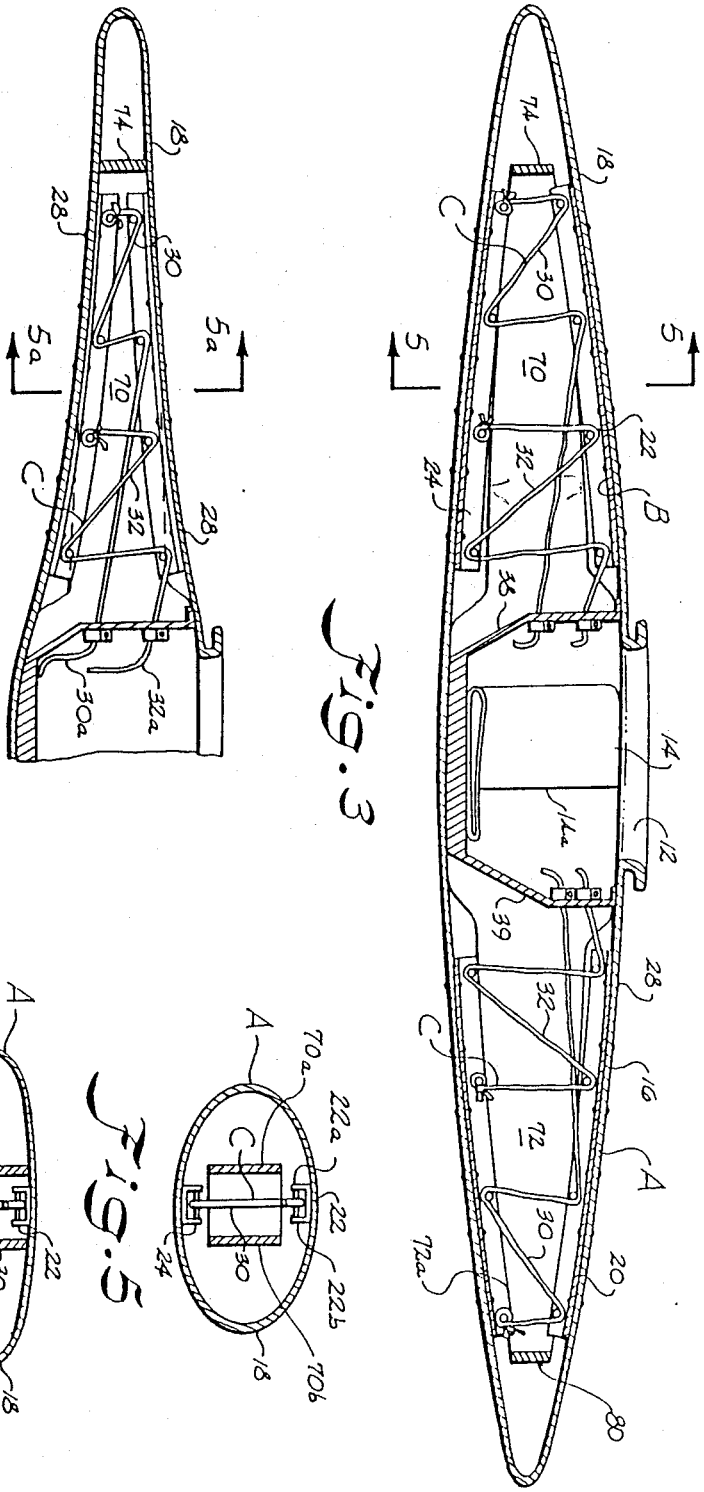
Fig. 3
Fig. 4
Fig. 5
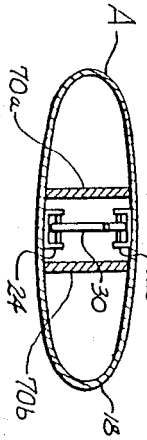
Fig. 5a

VARIABLE VOLUME KAYAK HULL

This is a continuation of co-pending application Ser. No. 766,567 filed on Aug. 19, 1985, now abandoned.

BACKGROUND OF THE INVENTION

The invention relates to boats which are utilized in the sport of whitewater boating, and more particularly to kayaks which can be adjusted in the volume of their hull for performing water acrobatics in whitewater.

Recently, the sport of water acrobatics has been developed in whitewater boating, particularly in kayaks. Boaters haved foud that the eddy currents in a river can be used with the bow or stern end of the hull partially sunk to do front and rear end stands, spins, and other type acrobatics in the water. For example, a kayak with its stern end submerged may be made to spin under the influence of side eddy currents. Once the spinning is started, the speed can be increased or decreased by the boater moving his hip back or forth. By utilizing subtle movements and paddling strokes, the spinning can be maintained.

The problem occurs that a kayak whose hull prescribes a fixed volume is suitable for water acrobatics for persons in a narrow weight range. A certain amount of weight is required to sink the bow or stern of the kayak hull. If a person is too light, the stern or bow portions will not be sufficiently sinkable for water acrobatics. The problem is basically one of volume versus weight. A decrease in the volume of the stern would render the hull sinkable by a lighter person.

Thus it is highly desirable to be able to vary the volume of the hull of a kayak so that the kayak may be tailored to the weight of a person for acrobatics in whitewater.

U.S. Pat. No. 2,612,129 discloses adjusting the keel of a boat hull for different power levels. In U.S. Pat. No. 4,480,579, issued to the applicant, a kayak with an adjustable rocker is disclosed providing a desired maneuverability depending on the whitewater conditions. This is highly desirable in order to adjust the kayak in different water conditions. However, none of the above teach varying hull volume to render the hull sinkable for water acrobatics.

Accordingly, an object of this invention is to provide a kayak whose hull may be adjusted in volume to render it sinkable over a wide range of boater's weight for the performance of water acrobatics.

Still another object of the invention is to provide a kayak whose hull can be adjusted in its volume without adding significant weight to the hull.

Another object of the present invention is to provide a kayak employing light-weight structure in a hull section by which volume changes in the hull section may be accomplished for water acrobatics in a manner which is simple and easily done by an average boater.

SUMMARY OF THE INVENTION

The above objectives are accomplished according to the present invention by providing a kayak whose hull is constructed from a semi-flexible plastic material in the bow and stern hull sections. Longitudinal frame members are connected within the hull and extend longitudinally in either or both of the bow and stern sections of the hull. The frame members are connected to opposing portions of the hull and may move towards or away from each other to adjust the cross-sectional configuration and volume of the hull. The frame members preferably include U-shaped channel members with transverse pins carried between the channel legs. A flexible cable is laced around the pins. By drawing or releasing the flexible cable, the channel members may be moved to vary the hull configuration and the hull volume. In another embodiment, U-shaped channels may also be secured to the flexible hull at four locations, ninety degrees apart, to provide further adjustability of the volume of the hull. Clamps may be provided for securing the cable in a prescribed lacing to establish a desired hull configuration and volume.

DESCRIPTION OF THE DRAWINGS

The construction designed to carry out the invention will hereinafter be described, together with other features thereof.

The invention will be more readily understood from a reading of the following specifications and by reference to the accompanying drawings forming a part thereof, wherein an example of the invention is shown and wherein:

FIG. 3 is a longitudinal sectional view of a kayak hull whose bow and stern sections have an adjustable volume in accordance with the present invention;

FIG. 4 is a sectional view of the kayak hull of FIG. 3 with the volume of the stern hull section adjusted in accordance with the present invention;

FIG. 5 is a sectional view taken along line 5—5 of FIG. 3;

FIG. 5*a* is a sectional view taken along line 5*a*—5*a* of FIG. 4;

DESCRIPTION OF A PREFERRED EMBODIMENT

Referring now in more detail to the drawings, a kayak is illustrated at 10 having a hull A which is formed as a flexible skin enclosure such as a polyethylene material. A suitable material is Marlex brand polyethylene manufactured by Phillips Chemical Company. The hull is typically made by utilizing rotational molding machinery or by vacuum molding to provide a continuous enclosed hull such as described in U.S. Pat. No. 4,227,272 issued to applicant, incorporated herein by reference.

Figure 1:
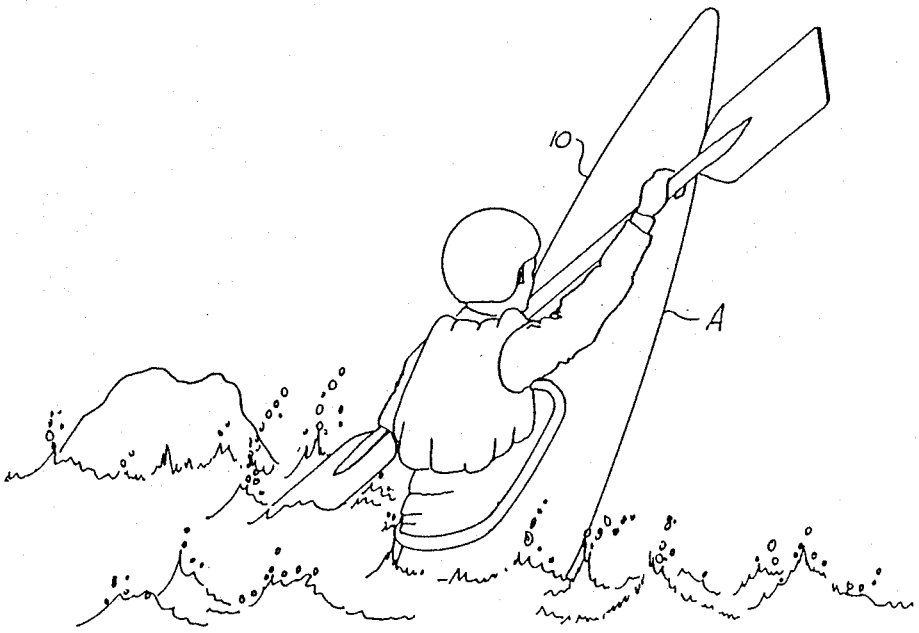
FIG. 1 is perspective view illustrating a boater in a kayak with the stern portion of the hull submerged below the water for water acrobatics.
Figure 2:
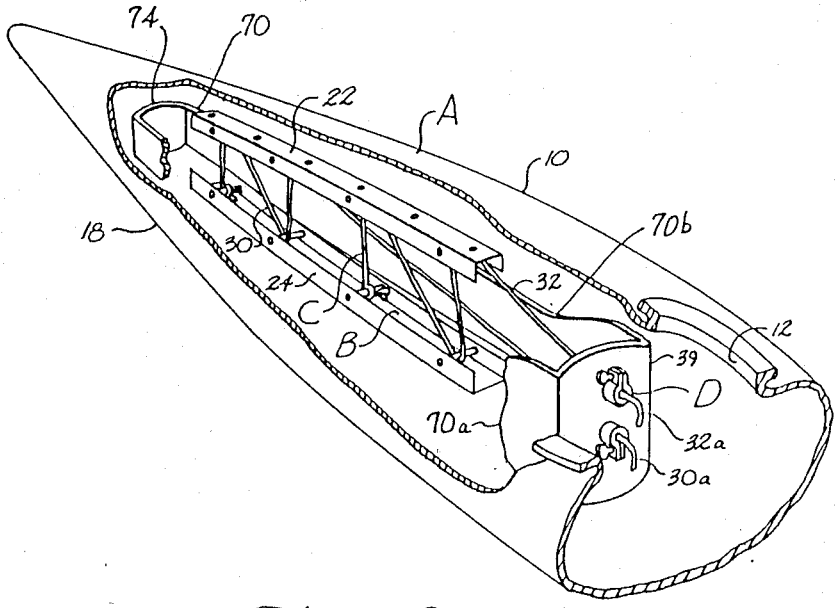
FIG. 2 is a perspective view with parts cut away illustrating a stern section of the kayak hull in FIG. 1 with an adjustable volume in accordance with the present invention.

Referring in more detail to FIGS. 2 and 3, it can be seen that a hull A includes a central opening 12 with a seat section 14 disposed therein afforded access by the opening 12. The hull A further includes a bow section 16 and a stern section 18 formed from flexible skin.

The volume of the hull A is normally prescribed by its unstressed state, as can best be seen in FIG. 3. In order to accomplish the desired objective of the present invention to provide a hull whose volume can be adjusted to the weight of the boater for water acrobatics, a means B is connected to the hull A for adjusting the volume of either the stern or bow section, or both.

Referring in more detail to FIGS. 3 through 6, it can be seen that the means B for adjusting the volume of the bow and stern sections includes a pair of opposing elongated frame means 22 and 24 carried by opposing interior surfaces of bow and stern sections 16, 18. Each of the frame means includes a U-shaped channel member oriented in the hull so that their open channels face each other. There is a plurality of pins 26 extended between the legs of each of the U-shaped channel members, for example legs 22*a* and 22*b* of channel member 22. The channel members are shown mounted to the top and bottom interior surfaces of the hull. Conventional fasteners 28 may be utilized to connect the channel members to the hull, for example, small bolts and nuts may be used.

In the preferred embodiment the pins 26 provide a connector means for interconnecting the channel members 22 and 24 with flexbile strands C in the form of cabling 30 and 32 laced between the pins 26 of the top and bottom channels 22, 24. By drawing the cables out, the channel members may be brought closer together to change the hull configuration and volume as can best be seen in FIGS. 4 and 6*a*. Alternately, having been brought closer together the cabling and channel members may be released to separate in accordance with the tension of the flexible skin 20 by releasing the cabling. The volume of the hull may be varied and tailored to the weight of a boater.

FIG. 5 is a cross-section of FIG. 3 taken along line 5—5 of FIG. 3 wherein the hull is in its natural unchanged state. By pulling or drawing the flexible strands 30 and 32 in the stern section, the cross-sectional configuration of the stern section taken along line 5*a*—5*a* is illustrated in FIG. 5*a*. It can be seen that the cross-sectional configuration is flattened relative to the cross-sectional configuration of FIG. 6. The volume is decreased requiring less weight for sinking of the hull in the water for tail-end water acrobatics. The change in configuration and volume may be fairly continuous along the length of the hull section 18 to which the cabling C and channels are connected. It is noted that the elongated frame means B extend a substantial length of the low 16 or stern 18 section in which they are placed so that the cross-sectional configuration of the hull in that section is made to vary in a continuous manner along its length when both cables are drawn.

Using two strands 30, 32 and flexible channels 22, 24, which may be made from plastic, the change in volume may be made either continuously or non-continuously (segmentally) along the length of the hull section. For example, as can best be seen in FIG. 4, cable 30 may be drawn upon without drawing cable 32. This will alter the configuration of a segment of the hull section 18 over which cable 30 interconnects the channels. The segment interconnected by cable 32 will not be appreicably changed. It is contemplated that relatively small changes in volume brought about by changes in small segments of a hull section may only be necessary for most boaters.

Means for fixing the flexible strand in a prescribed lacing pattern, may be provided by a clamp means D which may be any conventional wire or rope clamp 34 which is tightened by a thumbscrew. Each of the free end portions 30*a* and 32*a* of the flexible strands may be anchored to fix the laced cable by tightening the clamp D which then abuts an anchor plate 38 at the stern section 18 or an anchor plate 39 at the bow section 16. The cabling extends through the anchor plate where it is anchored.

Figure 6:
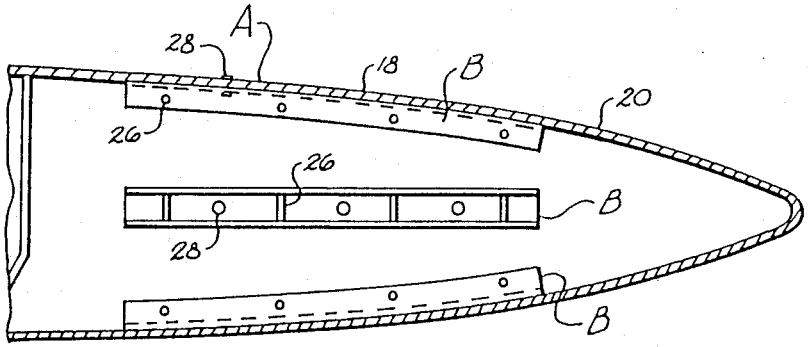
FIG. 6 is a sectional view of a hull section whose volume is adjustable in accordance with another embodiment of the invention.
Figure 9:
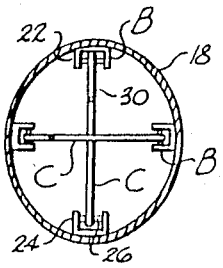
FIG. 9 is a cross section of a kayak hull having its volume adjusted in accordance with FIG. 6 of the present invention.

In FIG. 6, an alternate embodiment of the invention is illustrated wherein four of the elongated frame means B are provided and spaced generally equidistance around the interior's periphery of the hull section at ninety degree intervals. The flexible skin 20 of the hull illustrated in FIG. 5 may be drawn in from the top and bottom of the hull as well as from the opposing sides of the hull, for example, as seen in FIG. 9. By a top and bottom and a side pair of opposing elongated channel members B the cross-sectional configuration and hence the volume of the hull section may be futher varied.

Figure 7:
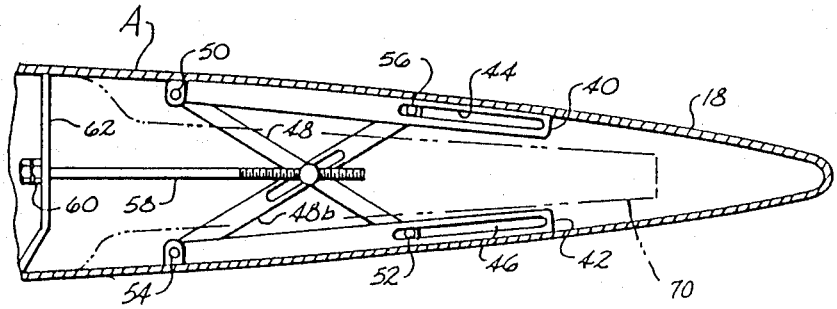
FIG. 7 is a sectional view of a kayak having an adjustable hull in accordance with another embodiment of the present invention.

FIG. 7 illustrates yet another embodiment of the present invention where the elongated frame means is illustrated in the form of a pair of opposing U-shaped channels 40 and 42 carried on opposing interior surfaces of the hull A which extend along a substantial length of the bow section of the hull. The U-shaped channel 40 includes a side slot 44 cut into each of its legs. There is a side slot 46 formed at each of the U-shaped channel legs of the channel member 42. Means for inter-connecting the channel member 40 and 42 include a scissor jack 48 having scissor legs 48*a* and 48*b*. The one end of leg 48*a* is privoted at 50. The other end of 48*a* includes a pin 52 received in the slots 46 of channel member 42. Leg 48*b* of the scissor jack includes one end which is pivoted at 54 and another end which is pinned at 56 into the side slots 44 of the channel member 40. There is a screw operator 58 which may be rotated to open or close the scissor and thus contract or expand the skin of the bow section 16 of the hull and adjust its volume. Access to the screw operator 58 may be had by turning a nut 60 and by carrying the screw operator in the anchor plate 39. Both the cabling C or screw 58 provide operator means for operating the channel members 22, 24, or 42, 44 to adjust the volume in accordance with the invention.

The channels 40, 42 may be flexible or sectional instead of continuous with pivots 50, 54 for segmental configuration hull changes.

Suitable framework may be provided for the kayak in the seat section by the sides 14*a* of seat 14, and the stern and bow anchor plates 38 and 39 which form partial bulkheads for the stern and bow sections. Additional supportive framework for the stern and bow sections may be provided in the form of foam beams 70 and 72 which keep the hull sections from totally collapsing. Beams 70 adn 72 may be one-piece with bulkhead plates 38 and 39, respectively. Beam 70 includes a pair of spaced identical beam panels 70*a* and 70*b* extending on side of the channels B to straddle cabling C or the scissor jack 48, as the case may be. The panels are joined at their end at 74. Beam 70 is contoured to be two or three inches away from the hull skin so that room is provided to accomodate the changes in hull configuration as can best be seen in FIGS. 5 and 5*a*. A side slot (not shown) may be formed in panels 70*a*, 70*b* to allow passage of horizontal cabling C in the embodimetn FIG. 6.

Figure 8:
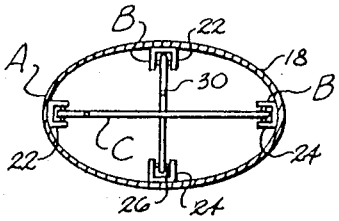
FIG. 8 is a cross-section of a kayak hull whose volume is adjusted in accordance with FIG. 6 of the present invention.

Beam 72 in bow section 16, is identical in construction to beam 70 and is unitary with bulkhead plate 39. Beam 72 includes two spaced beas panels straddling cabling C in the bow hull section, only one of which is shown at 72a. The panels are joined at 80. If the volume alignment structure B, C, is not included in a hull section, framework as shown in U.S. Pat. Nos. 4,227,272 and 4,440,144 may be utilized in that hull section. The framework 70 is omitted from FIGS. 6, 8, and 9 for purposes of clarity.

While a preferred embodiment of the invention has been described using specific terms, such description is for illustrative purposes only, and it is to be understood that changes and variations may be made without departing from the spririt or scope of the following claims.

What is claimed is:

1. A kayak having a hull constructed from a flexible material with a central seat section, enclosed bow and stern hull sections having prescribed enclosed volumes on respective sides of said central seat section, said kayak comprising:

means connected to opposed generally horizontal interior surfaces of one of said hull sections for deforming the hull cross-sectional configuration inwardly along an appreciable length thereof to change the volume of said one hull section and adjust the volume of said one hull section to the weight of a boater so that said one hull section may be submerged by the weight of said boater under water about its entire circumference along a portion of its length for performing water acrobatics.

2. The kayak of claim 1 wherein said means for changing the volume of said hull section includes means for altering the configuration of said hull section over a segment of said hull section less than its total length.

3. The kayak in claim 1 wherein said bow and stern sections taper generally from adjacent said central seat section toward an end of said section; said taper being defined by progressively reducing cross-sections which have a generally oblong profile and which progressively reduce in size towards the end of said sections; and said means for changing said volume includes longitudinal frame means connected over a substantial length of said section in a manner in which said cross-sectional profiles may be changed over various lengths of said hull section.

4. The kayak of claim 1 wherein said means for changing said volume of said hull section includes spaced longitudinal frame means carried longitudinally in said hull section by opposing interior surfaces of said hull section for contracting or expanding said hull section.

5. The kayak of claim 4 including connector means interconnecting said longitudinal frame means to vary the spacing between said frame means facilitating the respective contracting and expansion of said hull surfaces.

6. The kayak of claim 1 wherein said means for changing the volume of said hull section includes:

longitudinal frame means carried by opposing interior surfaces of said hull section in a manner in which said frame means are spaced apart;

connector means carried by said longitudinal frame means for receiving an elongated strand which is interlaced between said longitudinal frame means over a length thereof;

whereby said elongated strand may be drawn a released for contracting or expanding, respectively, said interior hull surfaces of said hull section to thereby adjust said volume.

7. The kayak of claim 6 including anchor means connected to said strand means for fixing said strand means and said longitudinal frame means in a prescribed interlaced condition with respect to each other.

8. The kayak of claim 4 wherein said longitudinal frame means includes a plurality of elongated U-shaped channels having a pair of channel legs and an open channel top, said open channel tops of opposing channels facing each other, and said connector means comprising pins carried between said legs of said U-shaped channel over which said strand means is laced between said opposing channels.

9. The kayak of claim 4 comprising four of said longitudinal frame means carried by interior surfaces of said hull which are arranaged generally ninety degrees from each other about said hull section whereby said flexible skin of said hull may be contracted and expanded in at least two opposing directions for altering the cross-sectional profile of said hull section and for adjusting the volume.

10. The kayak of claim 7 wherein said anchor means for anchoring a free end portion of said strand means includes an anchor plate through which said strand means is inserted, and a clamp attached to said free end portion abutting said anchor plate.

11. The kayak of claim 5 wherein said connector means includes a mechanical linkage connected between said opposing frame means; and operator means for adjusting said linkage means to move said frame means towards and away from each other.

12. The kayak of claim 11 wherein said mechanical linkage means includes a pair of scissor linkages which pivot and includes free ends connected in a sliding manner to said frame means; and said operator means moving said free ends toward and away from each other.

13. A kayak having a hull with a central seat section, enclosed stern and bow hull sections constructed from a generally flexible skin which provides an enclosure having a prescribed cross section configuration and enclosed volume for each said hull section comprising:

volume adjustment means connected to said hull for changing the enclosed volume of at least one of said enclosed hull sections which includes:

spaced longitudinal frame means carried by two opposing generally horizontal interior surfaces of said enclosed hull section; and connector means interconnecting said spaced longitudinal frame means for increasing or decreasing the spacing between said frame means to deform the cross-sectional configuration of said one hull section inwardly along a length of said hull section and adjust the volume of said hull section so that a boater may submerge a portion of said enclosed hull section under water about its entire circumference along a portion of its length.

14. The kayak of claim 13 wherein said frame means extends longitudinally along said oppposing interior surfaces of said hull section; and said connector means for interconnecting opposing frame means includes:

flexible strand means connected to said frame means at spaced points along the length of said longitudinally extending frame means and between said opposing frame means in a manner in which said strand means may be drawn or released to adjust the configuration of said hull section over a segment of said length; and means for anchoring a free end portion of said flexible strand in a position which holds the interconnected configuration of said strand.

15. The kayak of claim 14 wherein said strand means includes at least two separated flexible strands connected to said frame means.

16. The kayak of claim 13 wherein said connector means for interconnecting said opposing frame means comprises a mechanical scissor linkage having a pair of scissor-connected arms with one end each of said arms being connected in a sliding manner to said opposing frame means.

17. The kayak of claim 13 including at least two pairs of said opposing frame means carried by opposing interior surfaces of said hull section of said kayak for adjusting of said hull volume.

18. A kayak having a hull with enclosed bow and stern hull sections having an enclosed volume wherein at least one of said hull sections may be adjusted in its enclosed volume, and the kayak is characterized by volume adjustment means connected to opposing interior generally longitudinal surfaces of said one hull section over at least a segment of a length of said hull section for deforming the configuration of the enclosure of said segment of said hull section inwardly facilitating adjustment of said volume to that of the weight of the boater so that said enclosed hull section is rendered submergible about its entire circumference along a portion of its length by the weight of said boater for performing water acrobatics.

19. The kayak of claim 18 including operator means for manually changing said volume adjustment means.

20. The kayak of claim 18 wherein said volume adjustment means is connected to a substantial length of said hull section for adjusting the configuration and volume of said hull section in a manner which may be generally continuous over said length of said hull section, or only over said segement of said length.

21. The kayak of claim 18 including frame means carried within said hull section which limits inward movement of said surfaces of said hull section for accomodating changes in the configuration of said hull section and for preventing total collapse of said hull section.

* * * * *